United States Patent [19]

Widegren

[11] Patent Number: 4,822,071

[45] Date of Patent: Apr. 18, 1989

[54] GOLF BAG UNIT HAVING EXTENDABLE AND RETRACTABLE TRAVELLING WHEELS

[76] Inventor: John C. Widegren, S-114 31 Stockholm, Stockholm, Sweden

[21] Appl. No.: 201,140

[22] PCT Filed: Oct. 7, 1987

[86] PCT No.: PCT/SE87/00451

§ 371 Date: Jun. 2, 1988

§ 102(e) Date: Jun. 2, 1988

[87] PCT Pub. No.: WO88/02643

PCT Pub. Date: Apr. 21, 1988

[30] Foreign Application Priority Data

Oct. 8, 1986 [SE] Sweden ..... 8604277

[51] Int. Cl.[4] ..... B62B 1/12; A63B 35/08

[52] U.S. Cl. ..... 280/646; 280/47.25; 280/47.26; 280/DIG. 6

[58] Field of Search ..... 280/641, 645, 646, 652, 280/655, 37, 40, 42, 47.24, 47.25, 47.26, DIG. 6; 190/18 A

[56] References Cited

U.S. PATENT DOCUMENTS

| | | | |
|---|---|---|---|
| 1,926,184 | 9/1933 | Schwer | 280/DIG. 6 x |
| 2,359,870 | 10/1944 | Moreland | 280/DIG. 6 X |
| 2,629,609 | 2/1953 | Wilson | 280/DIG. 6 X |
| 2,701,725 | 2/1955 | Meiklejohn | 280/DIG. 6 X |
| 2,890,061 | 6/1959 | Watson | 280/47.26 |
| 4,053,169 | 10/1977 | Taylor | 280/DIG. 6 X |
| 4,588,055 | 5/1986 | Chen | 280/47.26 |

FOREIGN PATENT DOCUMENTS

| | | | |
|---|---|---|---|
| 213387 | 4/1957 | Australia | 280/DIG. 6 |
| 2528968 | 1/1976 | Fed. Rep. of Germany | 280/DIG. 6 |
| 2648587 | 6/1977 | Fed. Rep. of Germany | 280/DIG. 6 |
| 1172525 | 12/1969 | United Kingdom | 280/646 |

*Primary Examiner*—Charles A. Marmor
*Assistant Examiner*—Brian J. Johnson
*Attorney, Agent, or Firm*—Pollock, Vande Sande and Priddy

[57] ABSTRACT

A golf bag unit has extendable and retractable traveling wheels and comprises a tubular body (1) carrying a mounting device (2), to which is pivotally attached a pair of support legs (3), each with a traveling wheel (4), a bag (5) of flexible material coaxially surrounding the tubular body (1) and having a bottom support plate (6) for golf clubs, a pair of link arms (7) pivotally connecting with an actuation sleeve member (8), which is slidably movable on the tubular body (1), a compression spring (11) connected with said sleeve member (8), a control rod (12), which provides for a manual compression of the compression spring (11) during retraction of the wheel-carrying support legs (3) and a subsequent automatic extension of said legs (3) to the traveling position, a support ring (15) and a ground support foot (13). For facilitating the choice of the various golf clubs in the bag and for reducing the wear of the bottom of the bag, the invention suggests that the support plate (6) of the bag (5) is arranged freely slidably movable on the tubular body (1) between two positions.

4 Claims, 2 Drawing Sheets

GOLF BAG UNIT HAVING EXTENDABLE AND RETRACTABLE TRAVELLING WHEELS

Figure 1:
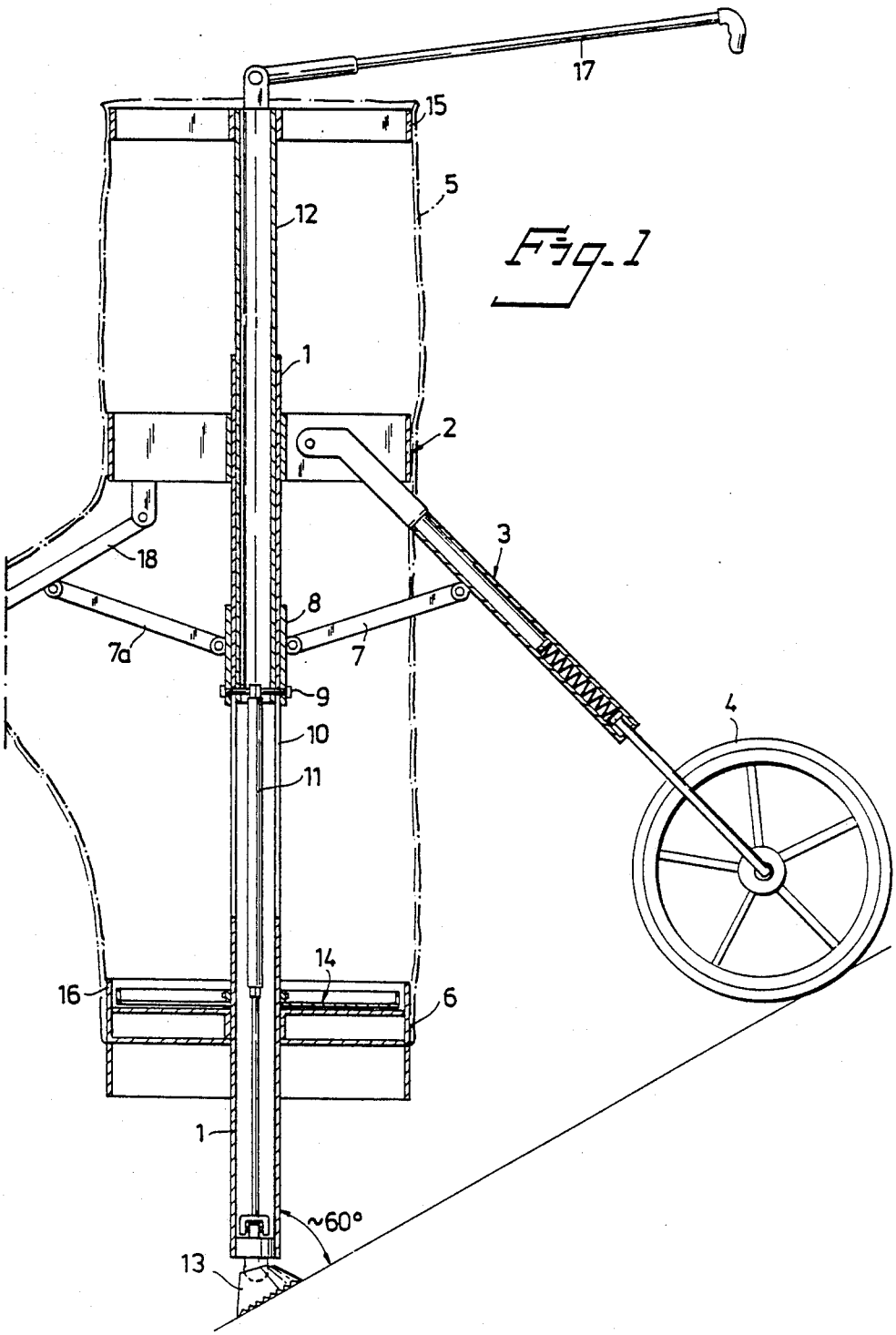

The present invention refers to a golf bag unit having extendable and retractable travelling wheels and comprising a tubular body, which extends centrally in longitudinal direction of the bag and which adjacent its upper end carries a mounting device, a pair of support legs, pivotally attached to said mounting device and at their free ends each carrying a travelling wheel, a bag of flexible material, which surrounds the tubular body in substantially coaxial and radially spaced relationship and in the bottom of which is mounted a support plate, upon which golf clubs standing in the bag can rest, a pair of link arms, each being pivotally connected at one end with one of the support legs at an intermediate position thereof and at its other end pivotally connected with an actuation sleeve member, which is slidably movable on the tubular body, a compression spring, which is mounted within the tubular body and through at least one entrainment device, which is slidably guided in an elongated slot in the wall of the tubular body, is connected at one end with said actuation sleeve member and at its other end with the lower portion of the tubular body, a tubular control rod, which is concentrically and slidably arranged within the tubular body and at one end connected with the upper end of said compression spring and with its opposite end extending beyond the end of the tubular body in order to provide for a manual compression of the compression spring during simultaneous retraction of the wheel-carrying support legs towards the tubular body and a subsequent automatic extension of said legs to the travelling position under the utilization of the energy thus stored in the compression spring, the bag furthermore being supported from the control rod at its upper end under the by means of a support ring attached to said rod, while the tubular body at its lowermost end is provided with a ground support foot.

Normally, the set of various clubs and balls as well as other accessories required for playing golf are stored in an approximately cylindrical elongated casing of a flexible material, usually called a golf bag. Since the weight of such a bag could amount to 10–15 kg most golf players originally engaged an assistant or so-called 'caddy' to carry said bag. With the ever-increasing spreading of the interest for playing golf all over the world said 'caddies' since long have been replaced by special collapsible carts on which the bags can be placed for being transported between the various holes along the golf course. As is well known, for climate reasons the outdoor season for playing golf is limited to the summer halfyear in Scandinavia and the northern parts of Europe. Simultaneously with the ever-increasing air charter traffic to primarily the countries around the Mediterranean, the golf sport also has become more moveable and geographically varied. However, most golf players want to play with their own clubs and in order to encourage golf tours by air the international air traffic organization IATA has allowed its members among the air companies to charge an overweight of only 4 kg for a golf bag, presupposed that all golf articles are accommodated within one and the same golf bag and that the total weight thereof does not exceed 15 kg.

However, the last-mentioned stipulation makes it impossible to bring along simultaneously a golf cart weighing 5–10 kg without payment of a particular overweight charge which usually amounts to over 20 SEK per kg or more than 200 SEK for a trip to and from the Mediterranean countries. Therefore, golf players have to hire golf carts at the travel target, which is rather expensive. Therefore, there has since long existed a need for a golf bag design which in itself accommodates travelling wheels in order to eliminate the need of a particular golf cart.

One suggestion to provide such a design has been disclosed e.g. in Applicant's own Swedish patent specification No. 7408665-3. The structure disclosed therein is based on the concept that a golf bag is provided with support legs with travelling wheels and said wheels are removable from said support legs in order to be arranged concentrically on the top of each other in the uppermost portion of the bag. This structure requires, however, that prior to placing the travelling wheels in the bag or removing them therefrom, all clubs must be removed from the bag. This has been considered to be laborious by most golf players. A rather different design of a wheel-equipped golf bag has also been proposed, in which the bag has approximately parallel epipedic box shape and in transverse direction is divided into three compartments. The central compartment is the greatest and only adapted to accommodate support legs and travelling wheels in retracted position while the two lateral compartments are adapted to accommodate the golf clubs. Therefore, there is still a need of a more compact and preferably also automatized construction of a wheel-equipped golf bag of the kind referred to.

The basic object of the present invention is now to provide a solution of the above-stated problem and this is achieved according to the invention substantially in that the support plate of the bag is arranged freely slidably movable on the tubular body, namely between a position of rest adjacent the ground support foot and a position of use spaced above said foot a distance corresponding to the extension movement of the control rod and hence of the bag support ring when extending the support legs.

Owing to the invention there can be achieved a plurality of advantages when compared with prior structures. Thus it is for instance no longer required that all clubs are removed from the bag in order to get access to the travelling wheels but the latter can be left mounted at the end of each support leg and said support legs are now automatically extendable while utilizing the stored spring energy. The bag becomes compact and maintains substantially the dimensions of previous golf bags without wheels. Similar to the Applicant's above-stated prior structure the travelling-wheel-equipped support legs with their mountings are well accommodated within the limit of the maximum allowable air freight weight of 15 kg for the whole bag. A further advantage of the structure according to the invention also is that the lower end of the bag will be spaced a distance from the ground by being moved upwardly along the tubular body when extending the support legs. By this it is avoided unnecessary wear of the said portion of the bag.

Figure 2:
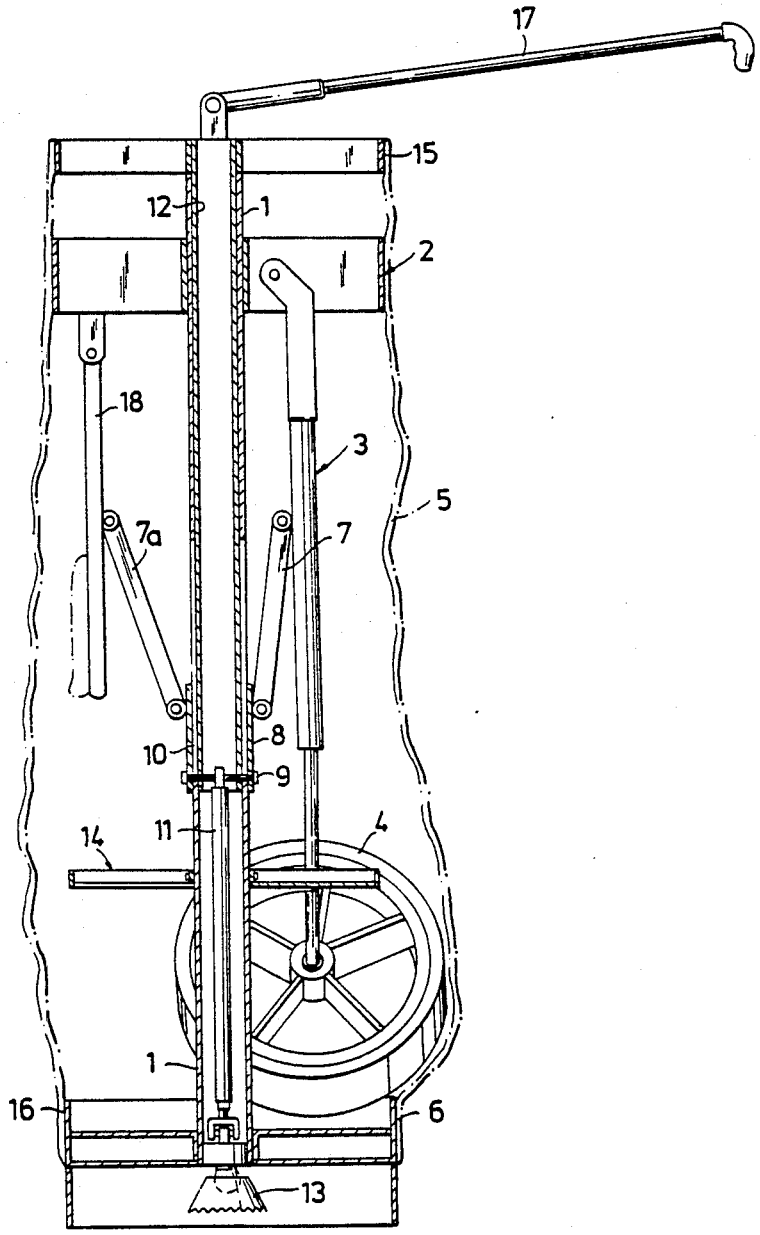

By way of example the invention will be further described below with reference to the accompanying drawing in which FIG. 1 illustrates a central longitudinal section through an inventive golf bag with the travelling-wheel-equipped support legs in extended position but with the very golf bag only indicated in phantom, and FIG. 2 illustrates a similar longitudinal section as FIG. 1 but with the wheel-equipped support legs in retracted position.

As is evident from the drawing a golf bag according to the invention comprises a tubular body 1, which extends centrally in longitudinal direction of the bag. At a position intermediate its ends and preferably spaced a small distance from the upper end of the tubular body 1 said body carries a mounting device 2 for two support legs 3. At its free end the respective support leg 3 carries a travelling wheel 4 and the tubular body 1 is in a substantially coaxial and radially spaced relationship surrounded by a bag 5 of flexible material. In the bottom of said bag is mounted a support plate 6 upon which not further illustrated golf clubs standing in the bag can rest.

The support legs 3 are pivotally journalled at the mounting device 2 and at a position intermediate their ends each hingedly connected to one end of a link arm 7. At its other end each link arm 7 is pivotally connected to an actuation sleeve member 8, which is slidably movable on the tubular body 1. In turn, said sleeve member is connected through at least one entrainment device 9, which is slidably guided in corresponding elongated slots 10 in the wall of the tubular body 1, with a compression spring 11 mounted within the tubular body 1. At its other end said compression spring 11 is secured to the lower portion of the tubular body 1. Preferably the mounting device 2 has the shape of five circumferentially equally spaced spokes extending radially from the tubular body 1 and at their outer ends mutually joined by means of a peripheral ring. Should the support legs 3 each be hingedly mounted to one of two adjacent spokes and pivotable in longitudinal planes therethrough they form between themselves a sufficiently great angle of 72° in order to provide desired stiffness in the travelling position. Then they will not interfere with golf clubs present in the bag.

For actuation of the compression spring 11 a control rod 12 is concentrically and slidably arranged within the tubular body 1, which control rod preferably is tubular and with its lower end connected with the upper end of the compression spring 11, while at its opposite end said rod protrudes beyond the tubular body 1 a suitable distance. The purpose of this is that by applying an axial pressure on the control rod 12 in the direction towards a support foot 13 located at the opposite end of the tubular body 1 and resting on the ground, the compression spring 11 can be manually compressed and tensioned by means of said control rod 12 under simultaneous slidable movement downwardly of the actuation sleeve member 8 and retraction of the travelling-wheel-equipped support legs towards the tubular body 1, after which the legs are locked in the retracted position in a suitable way not further illustrated. Thereby, the wheel-equipped support legs 3 are introduced through suitable slots in the bag 5.

When the support legs 3 again are to be extended their locking condition is released and thereby the energy stored in the compression spring 11 moves the actuation sleeve member 8 upwardly along the tubular body 1 while extending the support legs 3 to their final position, preferably defined by abutment against a portion of the mounting device 2.

At the lower end of the tubular body 1 is secured a substantially circular platform 14 for the shorter golf clubs and having a sector-shaped aperture at the side thereof situated opposite to the support legs 3 in order to allow a passage of the handles of the longer golf clubs, which thus instead are to rest upon the support plate 6 in the bottom of the bag 5. According to the invention the bag 5 is supported at its upper end by means of a support ring 15 rigidly secured to the control rod 12. On the contrary, the support plate 6 in the bottom of the bag 5 in this case has a central opening and is freely slidably movable along the tubular body 1. In the position of the support legs 3, in which they are retracted close to the tubular body 1 the support plate 6 in the bottom of the bag 5 then will be located adjacent the support foot 13 and hence spaced below the platform 14 a distance which substantially corresponds to the distance of the sliding movement of the control rod 12. Below the part of the platform 14, on which the handles of the shorter clubs rest, hereby is exposed a space which by suitable dimensioning of the travelling wheels 4 well can accommodate the latter such as is evident from FIG. 2. Thereby all golf clubs of both lengths are located with their heads approximately at the same level at the upper mouth of the bag 5. This provides for an optimum utilization of the space within the contour of the bag. When the support legs 3 then are extended, the further advantageous action is achieved, namely that the whole bag 5 with its bottom support plate 6 will move upwardly such that the support plate 6 will be located adjacent the platform 14. Owing to this the golf clubs will be located at substantially the same level with their handle ends and thus the longer clubs will protrude above the shorter ones at the bag mouth which facilitates the selection of the club to the player.

The last-mentioned structural design also provides for a possibility to achieve a certain selflocking action in the retracted position of the support legs 3. Should namely the latter be telescopically resilient such as hinted at in the drawing, the bottom support plate 6 of the bag 5 can be provided with an axial upwardly directed peripheral flange 16. At the end of the retraction movement the respective travelling wheel 4 then will be caused to pass over said flange while urging together the telescopic spring suspension of the support leg to then again expand inside said flange. When initiating an extending movement it is then usually only required an easy jerk by hand in any of the support legs 3 in order to bring the wheels 4 to pass again over the flange 16 and the extension will be fulfilled by the compression spring 11.

In this connection it is to be mentioned that the axial flange 16 also might extend downwardly, e.g. to the other side of the support plate 6 at least a distance corresponding to the height of the ground support foot 13. Thereby the bag will be able to stand steadily on the support plate 6 at the retracted position of the support legs 3.

In an alternative embodiment of the invention which has not been further illustrated in the drawing the freely slidable movement longitudinally of the support plate 6 in the bottom of the bag 5 has been substituted by a similar positive movement. In this case the tubular body 1 is provided at its lower end with a rigidly secured elongation which is arranged coaxially within the tubular control rod 12. In its turn, said rod is elongated downwardly beyond its point of connection with the upper end of the compression spring 11 as well as the lower end of the tubular body 1 and carries there rigidly the support plate 6 of the bag 5. The support plate thus is caused to positively participate in the sliding movements downwardly and upwardly of the control rod 12 relative the tubular body 1.

In order to provide for the movement of the bag 5 by means of the travelling wheels 4 a pulling handle 17 is hingedly connected to the uppermost end of the control rod 12. In case the control rod 12 is tubular, said pulling handle 17 easily can be made slidable into the control rod 12 such as known per se.

Another advantageous effect obtained by means of the invention is that at the actuation sleeve member 8 is hingedly secured at a position opposite to the mounting positions of the link arms 7 a further link arm *7a*, which at its opposite end is hingedly secured to a bracket arm 18, similarly connected hingedly to the mounting device 2 in order to carry a saddle-like seat located inside the wall of the bag 5 and not further illustrated in the drawing. Since the bracket arm 18 when extended will be located substantially parallel with the ground and the seat will be located at a position substantially vertically above the support foot 13, it is thus achieved a very steady seat facility for the golf player.

I claim:

1. A golf bag unit having extendable and retractable travelling wheels and comprising a tubular body (1), which extends centrally in longitudinal direction of a bag and which adjacent its upper end carries a mounting device (2), a pair of support legs (3), pivotally attached to said mounting device (2) and at their free ends each carrying a travelling wheel (4), a bag (5) of flexible material, which surrounds the tubular body (1) in substantially coaxial and radially spaced relationship and n the bottom of which is mounted a support plate (6), upon which golf clubs standing in the bag can rest, a pair of link arms (7), each being pivotally connected at one end with one of the support legs (3) at an intermediate position thereof and at its other end pivotally connected with an actuation sleeve member (8), which is slidably movable on the tubular body, a compression spring (11), which is mounted within the tubular body (1) and through at least one entrainment device (9), which is slidably guided in an elongated slot in the wall of the tubular body (1), is connected at one end with said actuation sleeve member (8) and at its other end with the lower portion of the tubular body (1), a tubular control rod (12), which is concentrically and slidably arranged within the tubular body (1) and at one end connected with the upper end of said compression spring (11) and with its opposite end extending beyond the end of the tubular body (1) in order to provide for a manual compression of the compression spring (11) during simultaneous retraction of the wheel-carrying support legs (3) towards the tubular body and a subsequent automatic extension of said legs (3) to the travelling position under the utilization of the energy thus stored in the compression spring (11), the bag (5) furthermore being supported from the control rod (12) at its upper end by means of a support ring (15) attached to said rod, while the tubular body (1) at its lowermost end is provided with a ground support foot (13), the support plate (6) of the bag (5) is being arranged freely slidably movable on the tubular body between a position of rest adjacent the ground support foot (13) and a position of use spaced above said foot (13) a distance corresponding to the extension movement of the control rod (12) and hence of the bag support ring (15) when extending the support legs (3).

2. A golf bag according to claim 1, characterized in that spaced a distance below the lower end of the slot (10) in the wall of the tubular body (1) is rigidly secured to said tubular body a substantially circular platform (14) having a sector-shaped aperture for the passage of long-handled golf clubs to the side of the platform (14) located opposite to the support legs (3).

3. A golf bag according to claim 1, characterized in that the compression spring is constituted by a gas spring (11).

4. A golf bag according to claim 1, characterized in that diametrically opposite to the support legs (3) is hingedly secured to the mounting device (2) one end of a bracket arm (18), which at its free ends supports a saddle-like seat and which at a position between its ends is hingedly connected to one end of a further link arm *(7a)*, the other end of which is hingedly connected to the actuation sleeve member (8), whereby the bracket arm (18) will be retracted and extended simultaneously with the support legs (3).

* * * * *